United States Patent [19]

Deane et al.

[11] 4,166,206

[45] Aug. 28, 1979

[54] METAL STRAP ELECTRICALLY GROUNDING A MOTOR TO A TIMER

[75] Inventors: Kenneth E. Deane, Beech Grove; Neil E. Grah, Fairland, both of Ind.

[73] Assignee: P. R. Mallory & Co. Inc., Indianapolis, Ind.

[21] Appl. No.: 850,110

[22] Filed: Nov. 9, 1977

Related U.S. Application Data

[63] Continuation of Ser. No. 617,976, Sep. 29, 1975, abandoned.

[51] Int. Cl.[2] ..... H01H 9/02

[52] U.S. Cl. ..... 200/293; 200/38 R; 310/68 C; 310/71D; 310/91

[58] Field of Search ..... 310/71, 273, 89, 91, 310/162–164, 68 C, 66; 174/51; 339/14, 14 L; 200/239–296, 38 B, 38 BA, 38 C, 38 CA, 38 R

[56] References Cited

U.S. PATENT DOCUMENTS

| | | | |
|---|---|---|---|
| 2,514,693 | 7/1950 | Chapman | 310/68 C |
| 3,582,582 | 6/1971 | Pauker | 200/38 B |
| 3,697,924 | 10/1972 | Oliver | 339/14 |
| 3,732,383 | 5/1973 | Voland | 200/293 |
| 3,760,314 | 9/1973 | Krasienko | 174/51 |
| 3,838,580 | 10/1974 | Ballard | 174/51 |
| 3,870,392 | 3/1975 | Bond | 174/51 |
| 3,875,462 | 4/1975 | Kiefer | 310/68 C |
| 3,885,847 | 5/1975 | Thibeault | 339/14 |
| 3,917,978 | 11/1975 | Menzel | 174/51 |

*Primary Examiner*—R. Skudy

*Attorney, Agent, or Firm*—Hoffmann, Meyer & Coles

[57] ABSTRACT

A metal strap is connected to a motor housing and to a metal mounting plate for a timer which carries the motor to electrically ground the motor to the timer.

2 Claims, 2 Drawing Figures

METAL STRAP ELECTRICALLY GROUNDING A MOTOR TO A TIMER

This is a continuation of application Ser. No. 617,976, filed Sept. 29, 1975, now abandoned.

Generally speaking, the present invention pertains to a combination of a timer and a motor carried by the timer and a means to electrically ground the motor, such means comprising a metal strap, first securing means securing an end of the strap to a housing for the motor, and a second securing means securing another end of the strap to a timer mounting plate carried by a housing for the timer.

As well known in the timer art, electrical motors, such as synchronous motors, are used in combination with timers to drive the timer, the timer then being used to actuate devices according to a programmed sequence. An example of such combinations is a motor used to drive a timer which in turn controls sequentially the elements of an applicance such as a dishwasher.

Because of the electric current being used by the motor and the timer it is essential that the both the timer and the motor be electrically grounded. In the case of the timer, it is usually grounded through a mounting plate which mounts the timer to the appliance. In the case of the motor, it is usually grounded through a lead wire connecting the motor to the timer. Because of safety reasons, pains must be taken to insure that such connections are securely made and therefore this method of grounding the motor is costly.

Accordingly it is a feature of the invention to provide a means to electrically ground an electric motor which is used in combination with a timer. Another feature of the invention is to provide such a means which is relatively inexpensive. Another feature of the invention is to provide a means of electrically grounding a motor to a mounting plate for a timer carrying the motor through a metal strap. Yet another feature of the invention is to provide such a metal strap which is secured at one end to the motor through spring tabs engaging a housing for the motor and at another end through a fastener. Still another feature of the invention is the provision of such a metal strap wherein the strap is additionally secured at the spring end through an aperture in the strap engaging a dimple extending from the motor housing.

Figure 1:
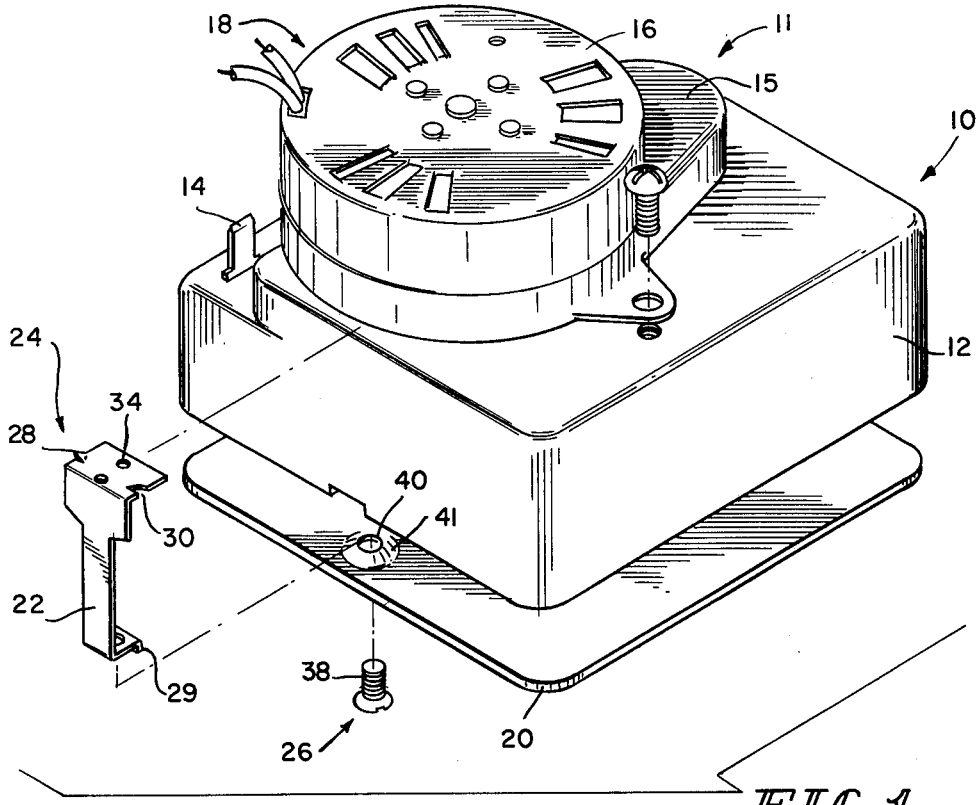
Figure 2:
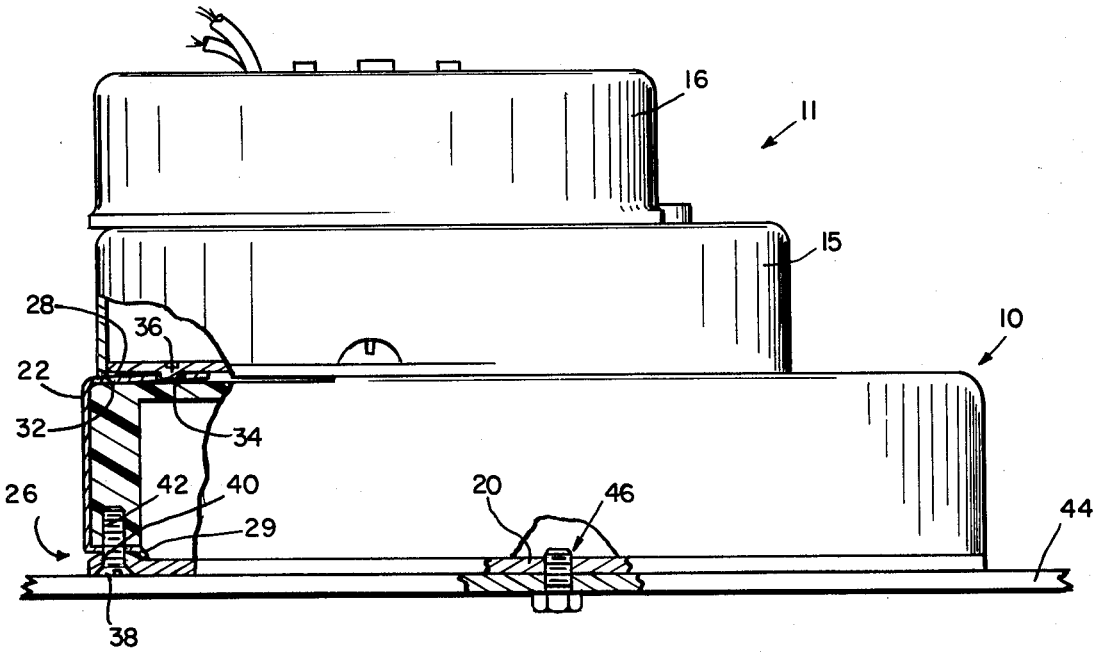

These and other features of the invention will become apparent from the following description taken in conjunction with the accompanying drawings wherein:

FIG. 1 is an exploded pictorial view showing a motor and a timer utilizing the invention: and FIG. 2 is a side view of the motor timer combination of FIG. 1 with portions thereof being removed.

Referring now to the drawings there is shown a timer 10 carrying a motor 11. This combination is well known in the industry and therefore will not be described in detail. Suffice it to say that the usual timer includes a housing 12 in which are carried rotatable cams and switching means which open and close in response to the cams rotation to open and close electrical circuits to devices or elements to be acutated, the currents being completed through electrical terminals 14. Typical of such timers is that disclosed in U.S. Pat. No. 3,582,582 issued June 1, 1971 to Kurt Parker, et al, which is incorporated herein by reference. Motor 11 is generally of the synchronous type and for the purposes of this invention includes a gear reduction means enclosed in a housing 15, the rotor, stator, and energizing means of the motor being encased in housing 16, the two housing together providing a complete housing 18 for the motor. The above noted U.S. Pat. No. 3,582,582 references a synchronous motor and illustrates its connection to a timer. The details of a synchronous motor for which the present invention could be used is described and illustrated in U.S. Pat. No. 3,676,725 issued July 11, 1972 to Joseph E. Wiser, et al, which is also incorporated herein by reference.

In accordance with the present invention, motor 11 is electrically grounded to timer mounting plate 20 through a metal strap 22. The metal strap is secured to the motor housing 18 through a first securing means 24 and to the mounting plate through a second securing means 26. First securing means 24 includes spring tabs 28 and 30 which are lanced from an end of the strap. Such tabs engage an edge 32 to hold the end in place. First securing means also includes an aperture 34 in the same end of the strap which engages a dimple 36 protruding from the motor housing.

Second securing means 26 includes a fastener such as a screw 38 extending through an aperture 40 provided in boss 41, in the opposite end of the strap and threading through an aperture 42 into the timer housing 12. The opposite end also includes a tab which is bent over boss 41 to further aid in holding the strap in place.

As shown, when the metal strap is in place it conforms to the outer shape of the housing for the timer.

As is well known in the art, the timer with the motor is mounted to a plate 44 through mounting plate 20 and fastener 46, plate 44 being a structural element of an appliance.

What is claimed is:

1. In a combination of a timer and motor carried by a housing for said timer and driving same, a means to electrically ground said motor comprising:

(a) a metal strap, (b) securing means securing an end of said strap to a housing for said motor including spring tabs lanced from said strap and engaging said housing for said motor and an aperture in said end engaging a dimple protruding from said housing for said motor, and (c) a fastener securing another end of said strap to a timer mounting plate carried by said housing for said timer.

2. In the combination according to claim 1 wherein said metal strap conforms to an outer shape of said housing for said timer.

* * * * *